US009875605B2

(12) United States Patent
Irby, II et al.

(10) Patent No.: US 9,875,605 B2
(45) Date of Patent: Jan. 23, 2018

(54) SEPARATELY SERVED USER INTERFACE FOR MOBILE GAMING

(71) Applicant: WMS Gaming, Inc., Waukegan, IL (US)

(72) Inventors: Michael J. Irby, II, Chicago, IL (US); Fredrik Arvidsson, Bromma (SE); Nisse A. Bergman, Johanneshov (SE); Per O. Hjelm, Farsta (SE); Markus P. Hogberg, Stockholm (SE); Andreas D. Larsson, Solna (SE)

(73) Assignee: BALLY GAMING, INC., Las Vegas, NV (US)

( * ) Notice: Subject to any disclaimer, the term of this patent is extended or adjusted under 35 U.S.C. 154(b) by 742 days.

(21) Appl. No.: 14/498,479

(22) Filed: Sep. 26, 2014

(65) Prior Publication Data

US 2015/0087418 A1 Mar. 26, 2015

Related U.S. Application Data

(60) Provisional application No. 61/883,055, filed on Sep. 26, 2013.

(51) Int. Cl.
*G07F 17/32* (2006.01)

(52) U.S. Cl.
CPC ..... *G07F 17/3227* (2013.01)

(58) Field of Classification Search
CPC ..... G07F 17/3227
See application file for complete search history.

(56) References Cited

U.S. PATENT DOCUMENTS

| | | | | |
|---|---|---|---|---|
| 6,256,780 | B1 | 7/2001 | Williams et al. | |
| 7,171,562 | B2 | 1/2007 | Brown et al. | |
| 7,389,417 | B1 | 6/2008 | Steinglass et al. | |
| 7,765,485 | B2 | 7/2010 | Baker et al. | |
| 7,908,221 | B2 * | 3/2011 | Bodmer | G06Q 20/382 705/64 |
| 8,015,546 | B2 | 9/2011 | Jones et al. | |
| 8,332,758 | B2 | 12/2012 | Bergeron et al. | |
| 8,347,270 | B1 | 1/2013 | Bouchard et al. | |
| 8,498,629 | B2 | 7/2013 | March et al. | |
| 2004/0242322 | A1 | 12/2004 | Montagna et al. | |
| 2005/0251809 | A1 | 10/2005 | Gunduc et al. | |
| 2012/0015724 | A1 * | 1/2012 | Ocko | A63F 13/335 463/31 |
| 2014/0051497 | A1 * | 2/2014 | Lang | G07F 17/3227 463/25 |

* cited by examiner

*Primary Examiner* — Jasson Yoo
(74) *Attorney, Agent, or Firm* — DeLizio Law, PLLC

(57) ABSTRACT

A user-interface for a game is separately serviced to game clients based on an identifier of a site providing a selection interface for the game. Multiple user interfaces for a game are stored. A resource server receives a request for a game that includes an identification of a web site issuing the request. The resource servers uses the identification to select a user interface module from the multiple user interface modules associated with the game. The selected user interface is assembled into the game and provided to a source of the request.

17 Claims, 9 Drawing Sheets

SEPARATELY SERVED USER INTERFACE FOR MOBILE GAMING

RELATED APPLICATIONS

This application claims the priority benefit of U.S. Provisional Application Ser. No. 61/883,055 filed Sep. 26, 2013.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

FIELD

Embodiments of the inventive subject matter relate generally to game systems, and more particularly to game systems that separately serve a user interface to gaming devices.

BACKGROUND

Online games such as online skill games, simulation games, wagering games and the like have become more and more popular over the years. Online games are typically server based games that are provided to online gaming clients over a network such as a wireless network or mobile phone network. Generally, the popularity of a game depends on the likelihood (or perceived likelihood) of winning the game and the intrinsic entertainment value of the game relative to other available gaming options. Players are likely to be attracted to the most entertaining and exciting games.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into five sections. The first section provides an introduction to embodiments of the invention, while the second section describes example operating environments. The third section describes example operations performed by some embodiments and the fourth section describes example computing devices on which the embodiments may execute. The fifth section presents some general comments.

Introduction

This section provides an introduction to some embodiments of the invention. Generally speaking, the embodiments provide bundled game assets to game clients. The game assets can include executable modules, audio data, video data, configuration files, etc. In some embodiments, a web site, for example, a game lobby, receives a request for a game from a client device. The game lobby receives device characteristics for the client device. The game lobby sends the device characteristics to a server. The server determines if an asset bundle has already been created for the client device based on the device characteristics. If an asset bundle has already been created, the asset bundle is provided to the client device. If an asset bundle does not exist for a client device having the indicated characteristics, the system creates an asset bundle, where at least some of the assets included in the bundle are determined, based at least in part, on the indicated device characteristics.

The assets for a game may include a user interface for the game. The user interface may be selected based, at least in part, on the game lobby that received a request for the game. For example, the user interface for the game may be customized so that the user interface provides a look and feel that is consistent with the game lobby.

Operating Environment

This section describes an example operating environment and presents structural aspects of some embodiments. This section includes discussion about various servers, services that support providing device specific asset bundles to client devices in example embodiments.

Figure 1:
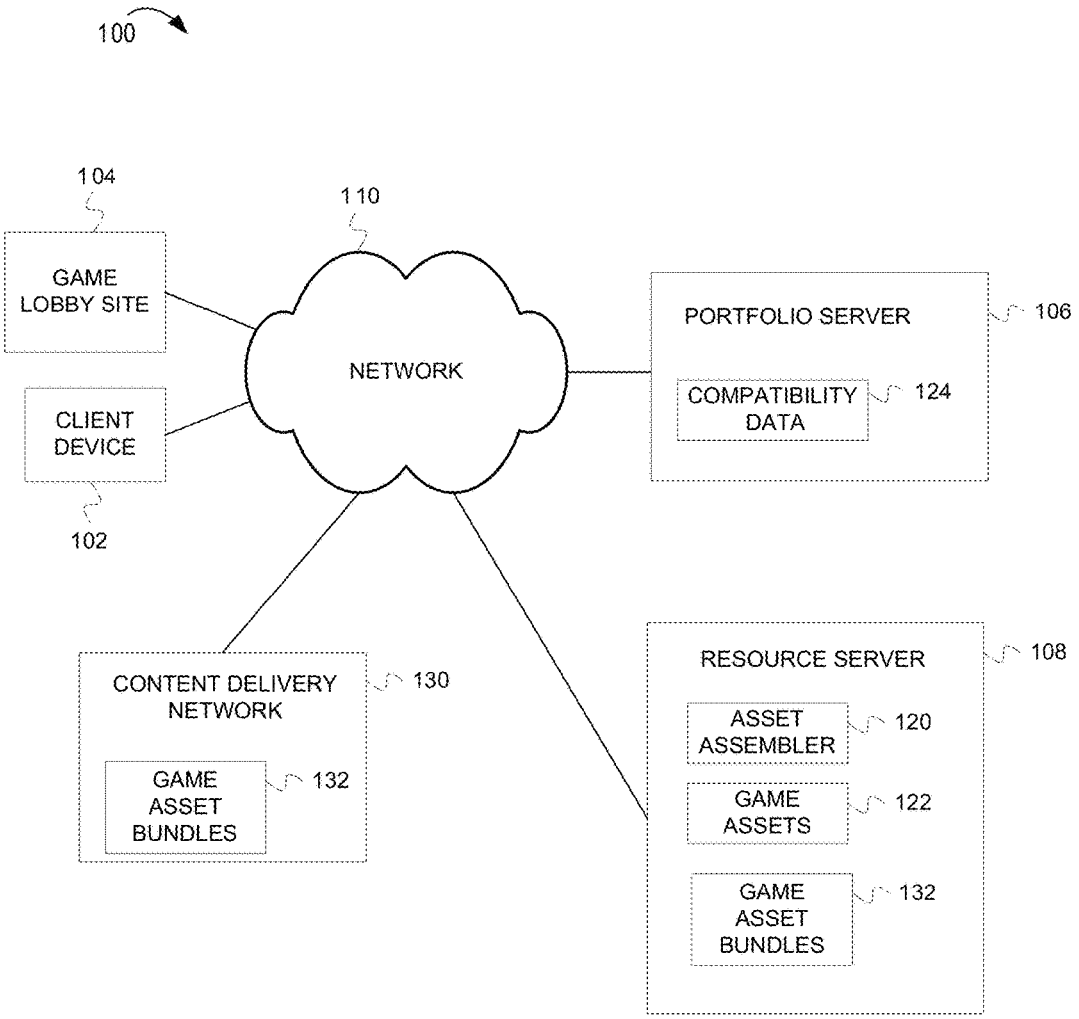
FIG. 1 is a block diagram illustrating a system for bundling assets according to embodiments.

FIG. 1 is a block diagram illustrating a system 100 for providing bundled assets for a game. In some embodiments, system 100 includes client device 102, game-lobby site 104, portfolio server 106, and resource server 108, each of which may be communicably coupled to network 110. Network 110 may be any combination of one or more wired or wireless networks. In some embodiments, network 110 may include the Internet.

Client device 102 may be any type of computing device capable of executing and presenting a game. Client device 102 can be a mobile device such as a mobile phone, smart phone, tablet computer, laptop computer, music player etc. Alternatively, client device 102 can be a personal computer or desktop computer, set-top box, gaming console or other device. The embodiments are not limited to any particular type of client device 102.

Game-lobby site 104 can be a web site provided by a casino operator or other entity that provides an interface to a client device 102 allowing a user of game client 102 to select a game for play on client device 102. In some embodiments, the games presented for selection by game-lobby site 104 may be online versions of wagering games such as video slots, blackjack, keno or other wagering games commonly found in casinos. In alternative embodiments, the games may be social games, i.e., games that do not involve the wagering of monetary value. Such games may award non-monetary value such as points, badges, trophies etc. or may unlock features of wagering games available in a casino. The embodiments are not limited to any particular type of game. A client device 102 may navigate to game-lobby site 104, where a selection of available games can be presented to the client device. Upon selection of a game, the game can be downloaded to client device 102 and begin execution on client device 102.

The games presented for selection on game-lobby site 104 may be provided by third parties with respect to the operator of game-lobby site 104. For example, a casino operator may request that a game developer make games available on a game-lobby site 104 operated or sponsored by the casino operator. Further, the casino operator may request that multiple game developers make games available on game-lobby site 104. In order to provide a common user experience, the casino operator may ask that the game developer customize the developer's games such that certain interactions or graphics are consistent with the game-lobby site 104.

Portfolio server 106 maintains a list of available games. In some embodiments, the list of available games may be maintained as compatibility data 124. Compatibility data 124 includes information on available games along with data regarding compatibility of games in the list of games with various device configurations. Game-lobby site 104 can access portfolio server 106 to obtain a list of games that are compatible with a particular type or configuration of client device 102. In some embodiments, the list of games may be provided as a "white/grey/black" list, where a game that is white listed is known to be operable or most likely to operate on a given configuration for client device 102. A black listed game is a game that is known to not operate or most likely will not operate on a given configuration for client device 102. A grey listed game is a game that may operate on a given configuration for client device 102, but at a reduced capability or with undesirable characteristics. In some instances, a gray listed game may operate with full functionality when an operation attempt is made, but is/was grey listed because some aspect of the client device 102 could not be initially identified, confirmed, or authenticated. In alternative embodiments, a white listing value may be provided by the portfolio server that indicates whether or not a game will operate on a particular configuration for a client device 102. The white listing value may be between 0 and 100, where a higher value indicates that a game is likely to operate well on a client device and lower values indicate that a game is not likely operate well on a client device 102.

In some embodiments, game-lobby site 104 receives the compatibility data 124 from portfolio server 106 and uses compatibility data 124 to determine a list of games that are presented on game-lobby site 104 for selection. Game-lobby site 104 can filter the list of games presented based on the characteristics of client device 102 that communicates with game-lobby site 104. For example, game-lobby site 104 can filter the list of games such that only games that are known to execute, or likely to execute, on client device 102 based on characteristics of client device 102 (e.g., "white listed" games). In alternative embodiments, game-lobby site 104 can filter the list of games to present for selection "white listed" games that are likely to execute or "gray listed" games that may execute, but potentially with diminished capability. "Black listed" games that are not likely to execute on client device 102 are filtered and are not presented. In further alternative embodiments, game-lobby site 104 can present all available games, along with an indication of how likely the game is to execute on client device 102. A user of client device 102 can then choose whether or not to select a game based on the indication of how likely the game is to execute on client device 102.

Resource server 108 maintains asset bundles for games. An asset bundle may include the executable code for parts of a game (e.g., UI (User Interface) code, adapter code, game-application code, etc.) and content for the game such as video content, graphical content and audio content presented during the game. In some embodiments, the executable code for a game may include HTML5 code. However, the embodiments are not limited to any particular type of code. A particular game may have multiple asset bundles that vary depending on the characteristics and configuration of a client device 102 that is to receive and execute the game. Thus resource server 108 may maintain multiple versions of asset bundles for a game, and may maintain asset bundles for multiple games.

Upon receiving a request for a game, resource server 108 can determine if an asset bundle already exists for the requested game that can operate on a client device 102 based on the characteristics of client device 102. If a suitable asset bundle already exists (e.g., a game-asset bundle in game-asset bundles 132), then resource server 102 provides the existing asset bundle. Alternatively, if a suitable asset bundle does not exist, an asset assembler 120 creates an asset bundle for the game by selecting game assets 122 for inclusion in a new asset bundle. Some or all of the assets in a game-asset bundle may be selected for inclusion in the new game-asset bundle based on characteristics of client device 102. The newly created game-asset bundle may then be provided to client device 102 through game-lobby site 104. In addition, the newly created game-asset bundle can be stored in game-asset bundles 132 and made available in response to subsequent requests for the game by client devices having the same or similar characteristics as client device 102.

Some embodiments include content delivery network (CDN) 130. CDN 130 can be a distributed system that caches content such as game-asset bundles for delivery to client devices 102 through game lobby 104. In embodiments including a content delivery network, game-asset bundles 132 for common configurations of client devices can be maintained on CDN 130 and made available on request to a game client 102 through game lobby 104.

Figure 2:
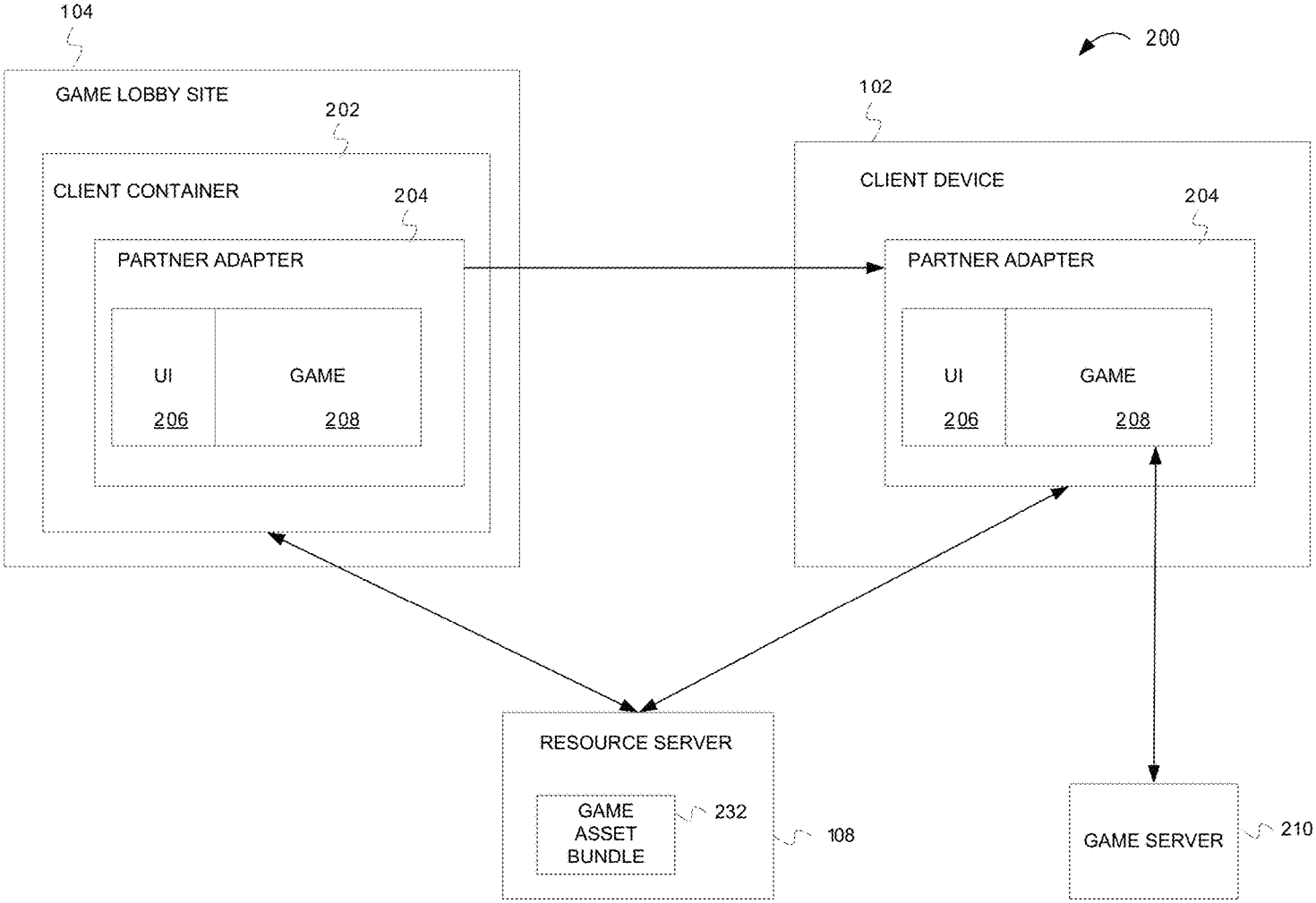
FIG. 2 is a block diagram illustrating a game having separately bundled game executable components according to embodiments.

FIG. 2 is a block diagram illustrating a game having separately bundled game executable components according to embodiments. The discussion of FIG. 2 assumes that resource server 108 either located a suitable device-specific game-asset bundle 232 for client device 102 in response to a request for a game or created a suitable game-asset bundle 232. In some embodiments, game-lobby site 104 provides a client container 202 to receive code portions of game-asset bundle 232 from resource server 108. In some embodiments, the code portions include partner adapter 204, user interface (UI) 206, and game 208. Generally speaking, partner adapter may include methods and functions that provide communication that may be specific to a particular game-lobby site. For example, if a game changes particular settings, or of the game-lobby site desires to change particular settings of a game (e.g., volume, pay lines etc.), such settings may be communicated between the game and game-lobby site via partner adapter 204. Thus partner adapter 204 can include code that provides various customizations of game features that may be specific to an operator of game-lobby site 104. Such customizations may include user interface customizations that are specific to a particular operator. For example, a casino operator may have particular requirements for interaction with a game that is to be provided in their game-lobby site 104. Such interactions can be provided by partner adapter 204, which can translate the interactions particular to the casino operator to interactions supported by UI 206 and game 208. In cases where a partner does not require any particular customizations, a generic partner adapter 204 can be provided.

UI 206 comprises a UI that is suitable for the characteristics of client device 102. For example, UI 206 may include interface elements that are positioned and sized according to a resolution and screen size of client device 102. Further, UI 206 may make operating system calls that are specific to an operating system (e.g., IOS, Android) running on client device 102. UI 206 may also include presentation characteristics that are customized for a particular game-lobby site 104. For example, a game-lobby site may provide a particular look and feel. The look and feel may include color schemes and graphical elements that are for the game-lobby site. An operator of a game-lobby site may desire a game provided through the game-lobby site to have similar or consistent color schemes or graphical elements. UI 206 may be customized to provide such color schemes and graphical elements. UI 206 may implement methods or functions that communicate game events such as spin events, specification of wager amounts, and credit meter amounts etc. between UI 206 and game 208.

Game 208 includes code that implements, at least in part the game mechanics for a game. For example, game 208 may include code that responds to player interaction via UI 206 and provides game outcomes to the player on UI 206. In some embodiments, game 208 communicates with a game server 210, which may implement a portion of a game. For example, game server 210 may include a central determinant component that determines an outcome for a game. Game server 210 may also maintain credit amounts, wager amounts and other wagering related data for a game executing on client device 102.

In some embodiments, after determining that a suitable game-asset bundle 232 is available for client device 102, game-lobby site requests partner adapter 204 and UI 206. Partner adapter 204 then requests game 208. Partner adapter 204, UI 206 and game 208 are loaded into client container 202. The contents of client container 202 are then provided to client device 102 for game execution. At various points of the operation of the game on client device 102, game 208 or UI 206 may obtain audio, video or other assets from game-asset bundle 232.

Figure 3:
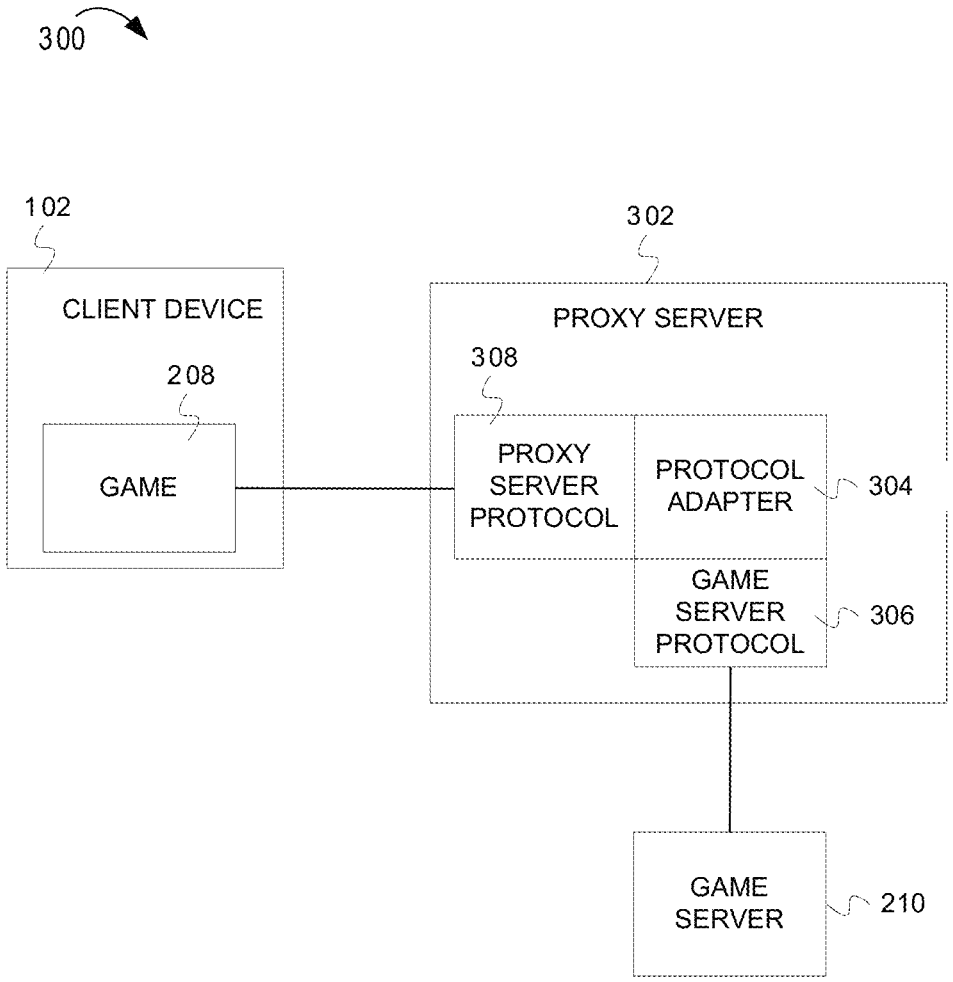
FIG. 3 is a block diagram illustrating a system including a proxy server for a game according to embodiments.

FIG. 3 is a block diagram illustrating a system including a proxy server for a game. In some embodiments, game 208 executing on client device 102 communicates with proxy server 302, which is an intermediary server between game 208 and game server 210. Proxy server 302 includes a proxy adapter 304 that translates between a first protocol, proxy server protocol 308, and a second protocol, game-server protocol 306. Game-server protocol 306 can be a session based protocol, and thus can be a stateful protocol. Further, game-server protocol 306 may be designed assuming that a network communicably coupling proxy server 302 to game server 210 has a minimum bandwidth and that connections between proxy server 302 and game server 210 are relatively stable. A network coupling client device 102 to proxy server 302 may not have the same characteristics as the network coupling proxy server 302 to game server 210. For example, when client device 102 is a mobile device, such network conditions may not be present. For example, client device 102 may be communicably coupled to a low bandwidth network. Additionally, client device 102 may be coupled to a network where connectivity may be difficult to maintain due to remoteness from a cell tower or access point. In some embodiments, proxy server protocol 308 is designed to accommodate such network conditions. For example, in some embodiments, proxy server protocol 308 is a connectionless, stateless, light-weight http protocol. Protocol adapter 304 maintains state information on behalf of game 208. Because proxy server protocol 308 is stateless, it is less sensitive to loss of packets or loss of network connectivity between client device 102 and proxy server 302. Thus if network connectivity is lost between client device 102 proxy server 302, proxy server 302 can still maintain game state and resume the game when network connectivity is reestablished between client device 102 and proxy server 302. In the event a connection is dropped between proxy server 302 and game server 210, proxy server 302 can reconnect to game server 210. Such self-reconnection can take place even if client device 102 is not currently connected to proxy server 302.

In addition, proxy server protocol 308 may compress data and use messages that are more readily parsed on client device 102 than messages that are part of game-server protocol 306. Further, proxy server protocol 308 may bundle multiple messages from game server 210 back to client device 102. Thus use of proxy server protocol 308 may provide suitable game performance even if network bandwidth between client device 102 and proxy server 302 is less than what would normally be considered desirable for communication with game server 210.

Although FIGS. 1-3 describe some embodiments, the following sections describe many other features and embodiments and provide further details on the above-described systems.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

The section will discuss FIGS. 4-8. The discussion of FIG. 4 will describe operations for bundling device specific game assets. The discussion of FIG. 5 will discuss providing multiple bundles of game assets to a client device. The discussion of FIG. 6 will describe a sequence of operations for providing device specific game-asset bundles. The discussion of FIGS. 7-8 will describe serving user interface code separately from other code for a game.

Figure 4:
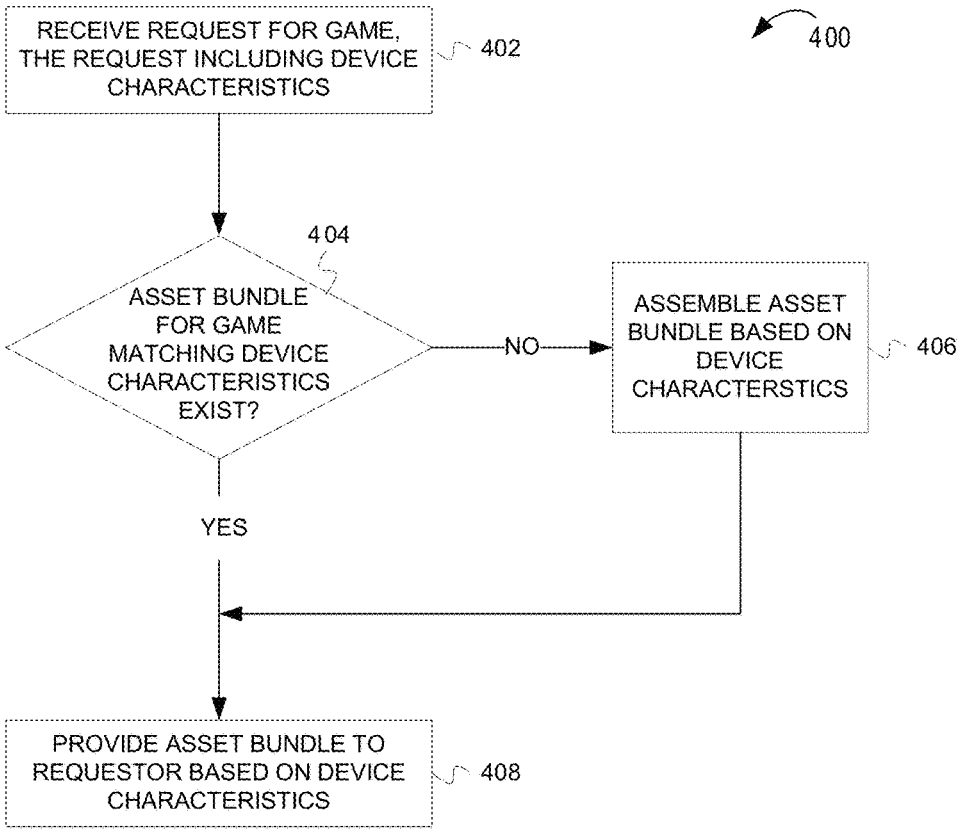
FIG. 4 is a flowchart illustrating a method for bundling game assets according to embodiments.

FIG. 4 is a flowchart illustrating a method 400 for bundling game assets according to embodiments. Method 400 begins at block 402 with receiving a request for a game, wherein the request includes device characteristics. In some embodiments, the request for the game may be issued by a game-lobby site 104 to a resource server 108. The device characteristics describe aspects of a client device 102 on which the game is to be executed. The device characteristics may have been provided to the game-lobby site as part of a game request by the client device. Alternatively, game-lobby site 104 may query client device 102 for its device characteristics or detect the device characteristics after the game has been requested by client device 102.

The device characteristics may include various features, configuration options, or aspects of client device 102. In some embodiments, the device characteristics may include various combinations of one or more of a device type, operating system type, operating system version, browser type, browser version, display size, display resolution, audio codecs (coder-decoder), language support, and network connection parameters (e.g., network type, bandwidth, etc.).

At block 404, resource server 108 determines if an asset bundle already exists that is compatible with the combination of device characteristics received at block 402. In some embodiments, the resource server can check if the asset bundle exists on resource server 108. In alternative embodiments, resource server 108 can check of the asset bundle already exists on a content delivery network 130.

If an asset bundle already exists that is compatible with the device characteristics, then the method proceeds to block 408, where the asset bundle compatible with the device characteristics is provided to the requestor.

If the check at block 404 determines that an asset bundle does not currently exist that is compatible with the device characteristics, then at block 406, resource server 108 assembles an asset bundle based, at least in part, on the device characteristics. The asset bundle can include code that is based on the device characteristics. For example, UI code or game code that is compatible with the operating system and browser type specified by the device characteristics may be included in the asset bundle. Further, video assets compatible with the screen size (or aspect ratio) and screen resolution may be included in the asset bundle. In some embodiments, a base version of a video or image asset may be created at high resolution. During the asset bundle creation, the base version of the audio or video asset may be scaled in accordance with the resolution and screen size of the target client device. The scaled video or image assets may then be included in the asset bundle. Audio codecs and audio assets compatible with device characteristics may be included in the asset bundle. Those of skill in the art having the benefit of the disclosure will appreciate that other types of assets may be included based, at least in part, on the device characteristics and that such inclusion of such assets is within the scope of the inventive subject matter.

In addition to inclusion of assets based on device characteristics, assets may be included that are based on an operator of game-lobby site 104. For example, assets that include branding specific to the operator may be included in the asset bundle.

After the asset bundle is assembled, the method proceeds to block 408 to provide the newly created bundle to the requestor. In some embodiments, the newly created bundle may also be cached to content delivery network 130 for use in satisfying future requests.

Figure 5:
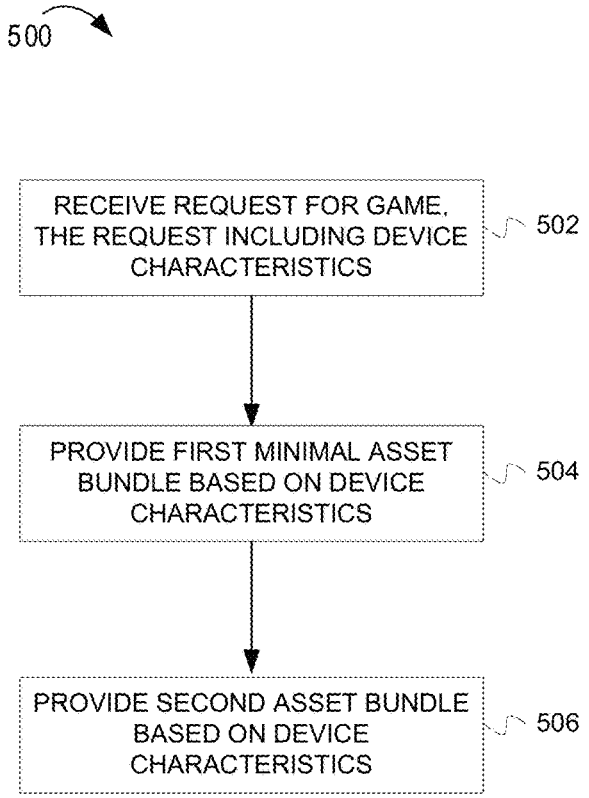
FIG. 5 is a flowchart illustrating a method for providing multiple bundles of assets for a game.

FIG. 5 is a flowchart illustrating a method 500 for providing multiple bundles of assets or portions of an asset bundle for a game. One factor that can have an impact on the desirability of a game is the amount time that elapses between when a game is selected and when a first round of play of the game can occur. The more time that elapses, the more likely it is that the player will become frustrated and not play the game. Thus in some embodiments, the delivery of game assets to a client device 102 is performed in a manner that minimizes the time that elapses between selection of a game and first play of the game.

Method 500 begins at block 502 with receiving a request for a game, where the request includes device characteristics. As with block 402 described above, the device characteristics describe aspects of a client device 102 on which the game is to be executed and may include various features, configuration options, or aspects of client device 102. In some embodiments, the device characteristics may include various combinations of one or more of an operating system, operating system version, browser type, browser version, display size, display resolution, audio codecs, language support, and network connection parameters (e.g., network type, bandwidth, etc.).

At block 504, a first minimal asset bundle is provided to the requestor. The first minimal asset bundle is configured to reduce the amount of time to first play of the game. Various options can be used to reduce the amount of time to first play of the game. In some embodiments, low resolution versions of video and audio assets can be included in the minimal asset bundle. The low resolution versions of video and audio assets are smaller in size, and thus do not take as much time to transmit over a network as would be the case with high resolution versions of the assets. Similarly, features, episodes or other aspects of a game that are not needed for a first round of play may be omitted from the first minimal asset bundle in order to reduce the amount of time taken to transmit the asset bundle.

At block 506 a second asset bundle is provided to the target device. The second asset bundle may be provided subsequent to initiation of a game on a target device. The second asset bundle may include higher resolution video, image or audio data, and may include code that implements features or game episodes that need not be present for the initial round or rounds of play. In some embodiments, the second asset bundle can be pushed to the target device. For example, the second asset bundle may be delivered in the background while the game is being played using the first asset bundle. As assets from the asset bundle become available, the game can detect that the asset is available and incorporate the asset into the game. In alternative embodiments, the second asset bundle may be pulled from a resource server 108 or content delivery network 130. As the game progresses, the game may pull assets as needed. Alternatively, the game may pull assets during idle periods of the game.

It should be noted that the term "minimal asset bundle" is not necessarily meant to mean the smallest possible bundle. Rather, minimal asset bundle as used herein refers to an asset bundle that is smaller in size or quicker to execute than an asset bundle that may fully implement a game.

In addition to staged downloading, some embodiments may assemble downloader code into a game based, at least in part, on the type of network or network bandwidth that is provided as part of the device characteristics for client device 102. The downloader code may obtain assets, for example bundled assets, in different ways depending on the network type or network bandwidth. As an example, assets may be made available individually. For instance, as a game requires an asset, the asset may be individually requested and downloaded. Alternatively, the downloader code may obtain assets that are packaged together as a unit. One example is a "Base64" package, where binary data is encoded into text. Those of skill in the art having the benefit of the disclosure will appreciate that other package formats are possible and within the scope of the inventive subject matter. Multiple game assets may be packaged together in a single package, which is downloaded by the downloader code. The assets in the package are then available to the game upon completion of the package download. The choice to download assets individually or as part of a package may be driven by the characteristics of networks coupling client device 102, game-lobby site 104, and resource server 108.

Figure 6:
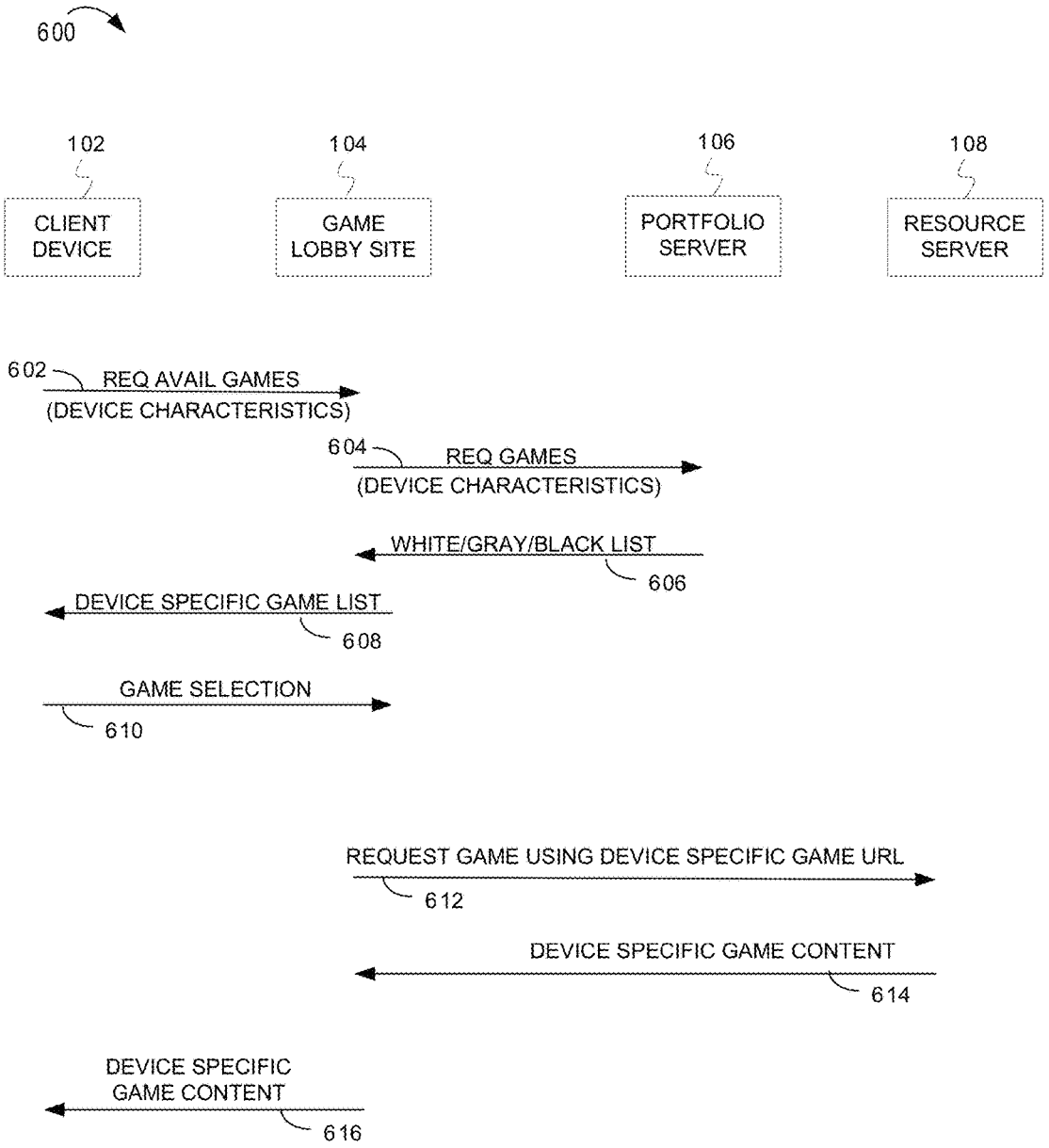
FIG. 6 is a sequence diagram illustrating an example sequence of operations for providing bundled assets for a game.

FIG. 6 is a sequence diagram illustrating an example sequence 600 of operations 600 for providing bundled assets for a game. The example sequence of operations is meant to illustrate an example sequence of operation of the methods and systems described above. Various embodiments may provide fewer operations or more operations than described below, and may perform operations in a different order than described below.

Sequence 600 begins at operation 602 with a client device 102 requesting a list of available games from game-lobby site 104. In some embodiments, the request may originate from a browser executing on client device 102. The request may include device characteristics describing attributes and features of the requesting device. If the request does not include device characteristics, game-lobby site 104 may query device 102 for device characteristics or perform operations (or cause device 102 to perform operations) to detect device characteristics.

At operation 604, game-lobby site issues a request to portfolio server 106 for games that are available for execution based on the device characteristics of client device 102.

At operation 606, portfolio server 106 returns a list of available games that can execute on client device 102 based on the supplied device characteristics. In some embodiments, the list of available games may be a "white/gray/black" list of games, where a white list includes games that are likely to execute well on client device 102, a grey list is a list of games that may execute on client device 102, but with reduced functionality or minor defects, and a black list is a list of games that are not likely to be executable on client device 102. In alternative embodiments, the list of available games may include a numeric indicator, letter grade indicator, or other type of indicator of how likely it is that a game will execute on client device 102. The list of available games can also include a device specific URL (Uniform Resource Locator) identifying the location of the game-asset bundle that is compatible with client device 102 based on the indicated characteristics.

Game-lobby site 104 receives the list from portfolio server 106 and at operation 608, presents a device specific game list for selection by a user of client device 102. In some embodiments, portfolio server may filter the list of games to include only those games that are known to execute well on client device 102. In alternative embodiments, portfolio server may filter the list to include games that are known to execute well and games that may execute with some reduced functionality or minor impairment. In further alternative embodiments, game-lobby site 104 may present the entire list of games along with the likelihood of success indicator and allow a user to determine whether or not to select the game based on the likelihood of success.

At operation 610, game-lobby site 104 receives a selection of a game from client device 102.

At operation 612, game-lobby site 104 obtains a device specific game-asset bundle compatible with device 102 from resource server 108. Resource server 108 may use the methods described above to provide the game-asset bundle. In some embodiments, the device specific game-asset bundle may be retrieved from a content delivery network 130.

At operation 616, game-lobby site 104 provides the device specific game content to client device 102, which may then begin execution of the game.

Figure 7:
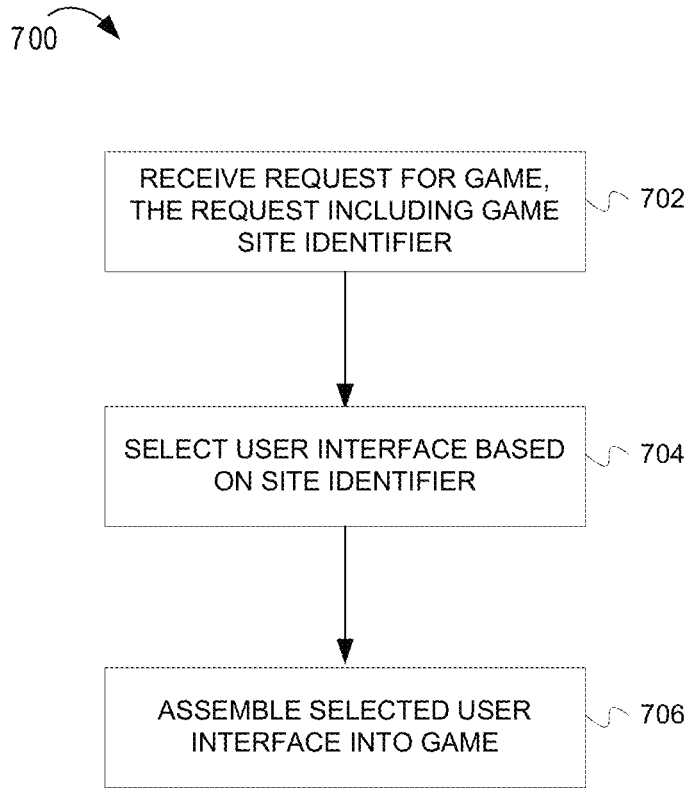
FIG. 7 is a flowchart illustrating a method for separately serving user interfaces for a game.

FIG. 7 is a flowchart illustrating a method 700 for separately serving user interfaces for a game. As discussed above, game-lobby site operators may desire that games provided through their game-lobby sites have a consistent look and feel. Some embodiments provide a user interface that is separately served as part of providing a game to a requestor. The separately served user interface can provide a customized user interface for a game-lobby site while maintaining the same game mechanics of a game.

Method 700 begins at block 702 by receiving a request for a game, where the request includes a game site identifier. The request may be in the form of a HTTP request, where a parameter of the request includes the game site identifier. The game site identifier may be included with other parameters, such as the device characteristics parameters discussed above. The game site identifier may be a text string identifying the game site, a GUID (Globally Unique Identifier), or other code identifying the game site.

At block 704, a system receiving the request (e.g., resource server 108) selects a user interface module based, at least in part, on the game site identifier. The user interface module may also be selected, based at least in part, on device characteristics included in the request. The selected user interface module may be one that has been customized based on requests of the game site operator to provide particular placement of user interface elements and to provide video, graphical, or audio elements that are specific to the game site operator.

At block 706, the system assembles the selected user interface module into a game to be delivered to the requestor.

Figure 8:
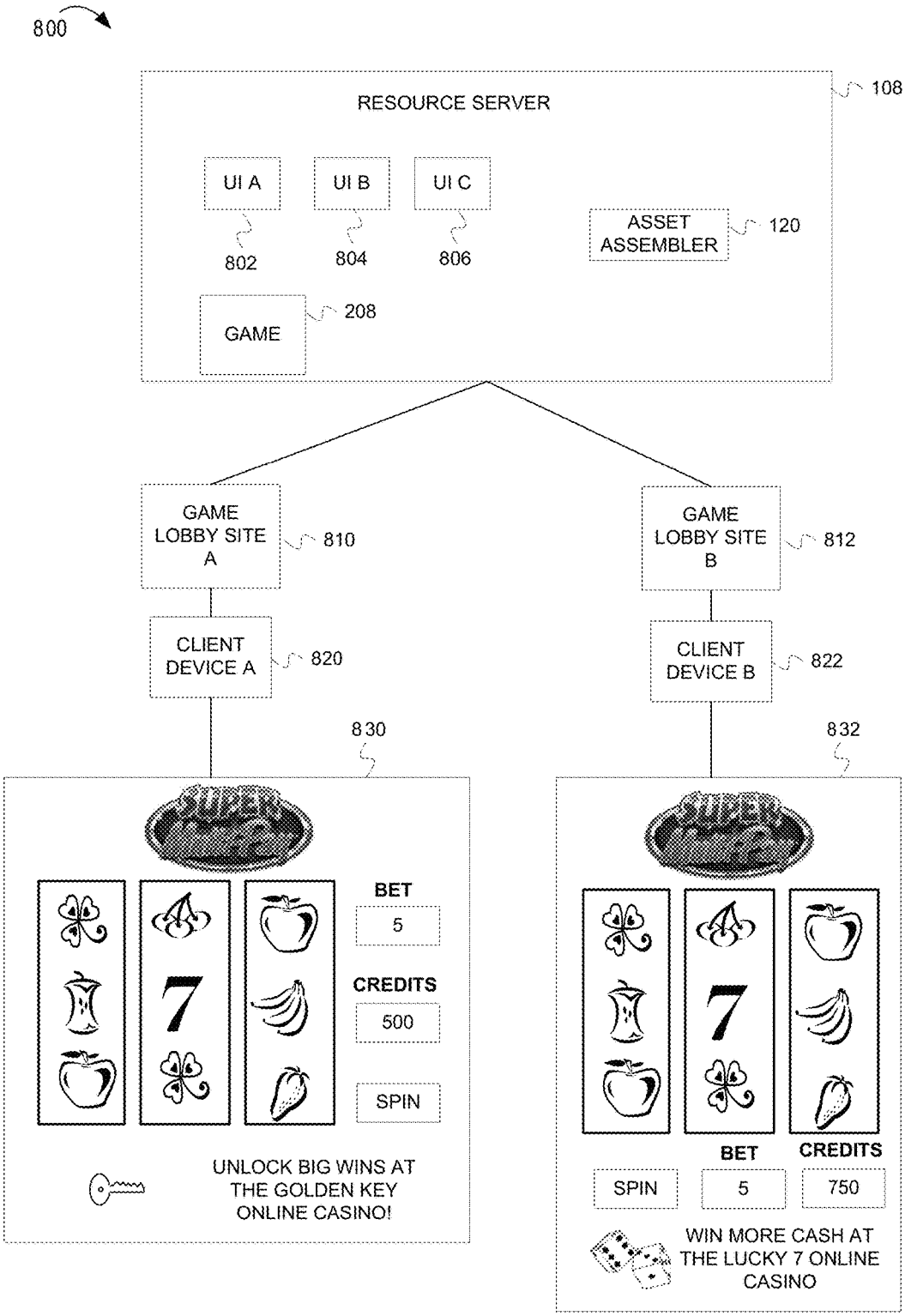
FIG. 8 is a diagram illustrating separately served user interfaces.

FIG. 8 is a diagram illustrating an example system 800 for separately serving user interfaces. Example system 800 includes resource server 108, game-lobby site A 810, communicably coupled to resource server 108 and client device A 820, and game-lobby site B 812 communicably coupled to resource server 108 and client device B 822. For the purposes of the example, game-lobby site A 810 and game-lobby site B 812 are owned and operated by different entities and have different requirements regarding the look and feel of games provided through their respective game lobbies. In particular, game-lobby site A may specify that bet amounts, credit meters, and spin interface elements appear to the right side of the reels of a game, while game-lobby site B may specify that bet amounts, credit meters and spin interface element appear below the reels of a game. In addition, both of game-lobby sites 810 and 812 may specify graphic elements that are to appear on the interface. In the example illustrated in FIG. 8, assume that game-lobby site A 810 is owned and operated by the hypothetical "Golden Key Casino" and that game-lobby site B is owned and operated by the hypothetical "Lucky 7" casino. Further assume that both game-lobby site A 810 and game-lobby site B are configured to provide access to the same game 208, which for the purposes of this example may be "Super Multi-Pay" from WMS Gaming, Inc.

A user of client device A 820 may browse to game-lobby site A 810. Game-lobby site A may present a list of games compatible with the client device 820. One of the games present may be Super Multi-Pay. Upon selection of Super-Multi-Pay, game-lobby site 810 may request the game from resource server 108, which executes one or more of the methods described above to assemble one or more game-asset bundles for loading onto client device 820 through game-lobby site A 810. As part of assembling the game-asset bundles, resource server 108 determines that the request includes an indication that game-lobby site A 810 issued the request. Resource server 108 further determines that UI A 802 is associated with game-lobby site A 810. Thus resource server 108 includes UI A 802 into game code to be delivered to client device 820.

Similarly, a user of client device B 822 may browse to game-lobby site B 812, which presents a list of games compatible with the client device 822. Game-lobby site B 812 also may present the Super Multi-Pay game as an option. Upon selection of Super-Multi-Pay, game-lobby site 812 may request the game from resource server 108, which again executes one or more of the methods described above to assemble one or more game-asset bundles for loading onto client device 822 through game-lobby site A 812. As part of assembling the game-asset bundles, resource server 108 determines that the request includes an indication that game-lobby site B 812 issued the request. Resource server 108 further determines that UI B 804 is associated with game-lobby site B 812. Thus resource server 108 includes UI B 804 into game code to be delivered to client device 822.

During operation of game 208 on client device A 820, UI A 802 presents interface 830 on client device A 820. During operation of game 208 on client device B 822, UI B 804 presents interface 832 on client device B 822. While interface 832 and interface 832 have differences based on the requirements of the operator of the respective game-lobby site providing access to game 208, the underlying mechanics of game 208 are the same.

As can be seen from the above, user interfaces for a game can be separately served as part of process of assembling game code and game assets. Thus a customized user interface may be developed without requiring changes to the underlying game code that provides the game mechanics. The customized user interface may be separately served from the underlying game module. In other words, customized user interfaces may be separately served when desirable for a particular game-lobby site while the same underlying game module can be reused across multiple game-lobby sites.

Example Computing Systems

Figure 9:
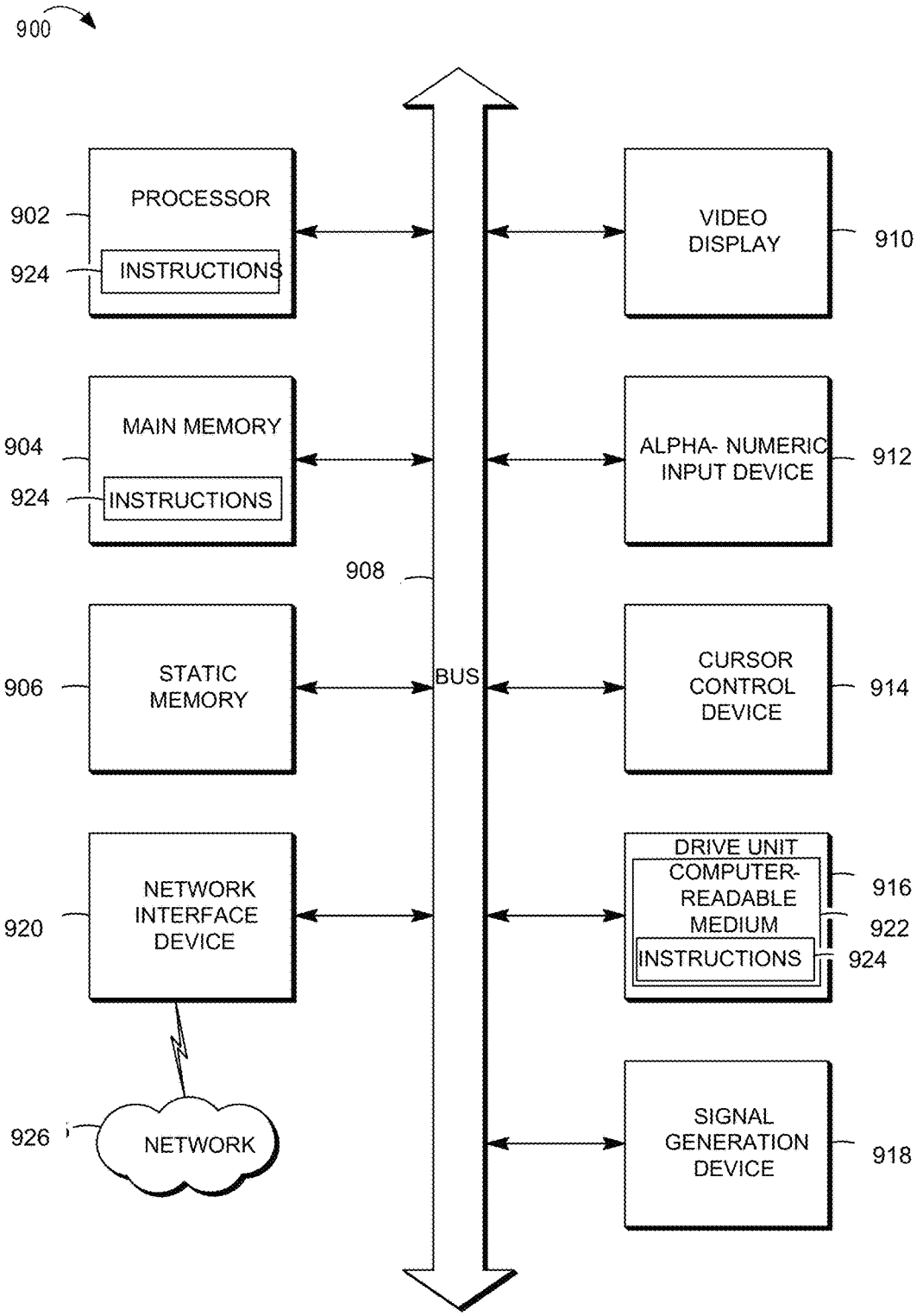
FIG. 9 is a block diagram of an example embodiment of a computer system upon which embodiments of the inventive subject matter can execute.

FIG. 9 is a block diagram of an example embodiment of a computer system 900 upon which embodiments of the inventive subject matter can execute. The description of FIG. 9 is intended to provide a brief, general description of suitable computer hardware and a suitable computing environment in conjunction with which the invention may be implemented. In some embodiments, the invention is described in the general context of computer-executable instructions, such as program modules, being executed by a computer. Generally, program modules include routines, programs, objects, components, data structures, etc., that perform particular tasks or implement particular abstract data types.

As noted above, the system as disclosed herein can be spread across many physical hosts. Therefore, many systems and sub-systems of FIG. 9 can be involved in implementing the inventive subject matter disclosed herein.

Moreover, those skilled in the art will appreciate that the invention may be practiced with other computer system configurations, including hand-held devices, multiprocessor systems, microprocessor-based or programmable consumer electronics, network PCS, minicomputers, mainframe computers, and the like. The invention may also be practiced in distributed computer environments where tasks are performed by I/O remote processing devices that are linked through a communications network. In a distributed computing environment, program modules may be located in both local and remote memory storage devices.

In the embodiment shown in FIG. 9, a hardware and operating environment is provided that is applicable to both servers and/or remote clients.

With reference to FIG. 9, an example embodiment extends to a machine in the example form of a computer system 900 within which instructions for causing the machine to perform any one or more of the methodologies discussed herein may be executed. In alternative example embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. Further, while only a single machine is illustrated, the term "machine" shall also be taken to include any collection of machines that individually or jointly execute a set (or multiple sets) of instructions to perform any one or more of the methodologies discussed herein.

The example computer system 900 may include a processor 902 (e.g., a central processing unit (CPU), a graphics processing unit (GPU) or both), a main memory 904 and a static memory 906, which communicate with each other via a bus 908. The computer system 900 may further include a video display unit 910 (e.g., a liquid crystal display (LCD) or a cathode ray tube (CRT)). In example embodiments, the computer system 900 also includes one or more of an alpha-numeric input device 912 (e.g., a keyboard), a user interface (UI) navigation device or cursor control device 914 (e.g., a mouse), a disk drive unit 916, a signal generation device 918 (e.g., a speaker), and a network interface device 920.

The disk drive unit 916 includes a machine-readable medium 922 on which is stored one or more sets of instructions 924 and data structures (e.g., software instructions) embodying or used by any one or more of the methodologies or functions described herein. The instructions 924 may also reside, completely or at least partially, within the main memory 904 or within the processor 902 during execution thereof by the computer system 900, the main memory 904 and the processor 902 also constituting machine-readable media.

While the machine-readable medium 922 is shown in an example embodiment to be a single medium, the term "machine-readable medium" may include a single medium or multiple media (e.g., a centralized or distributed database, or associated caches and servers) that store the one or more instructions. The term "machine-readable medium" shall also be taken to include any medium that is capable of storing, encoding, or carrying instructions for execution by the machine and that cause the machine to perform any one or more of the methodologies of embodiments of the present invention, or that is capable of storing, encoding, or carrying data structures used by or associated with such instructions. Machine-readable media may include machine-readable storage media and machine-readable signal media. The term "machine-readable storage medium" shall accordingly be taken to include, but not be limited to, solid-state memories and optical and magnetic media that can store information in a non-transitory manner, i.e., media that is able to store information for a period of time, however brief. Specific examples of machine-readable storage media include non-volatile memory, including by way of example semiconductor memory devices (e.g., Erasable Programmable Read-Only Memory (EPROM), Electrically Erasable Programmable Read-Only Memory (EEPROM), and flash memory devices); magnetic disks such as internal hard disks and removable disks; magneto-optical disks; and CD-ROM and DVD-ROM disks.

The instructions 924 may further be transmitted or received over a communications network 926 using a transmission medium via the network interface device 920 and utilizing any one of a number of well-known transfer protocols (e.g., FTP, HTTP). Examples of communication networks include a local area network (LAN), a wide area network (WAN), the Internet, mobile telephone networks, Plain Old Telephone (POTS) networks, and wireless data networks (e.g., WiFi and WiMax networks). The term "machine-readable transmission medium" shall be taken to include any intangible medium that is capable of storing, encoding, or carrying instructions for execution by the machine, and includes digital or analog communications signals or other intangible medium to facilitate communication of such software. Such communications signals may include a propagated data signal with computer readable program code embodied therein, for example, in baseband or as part of a carrier wave. Such a propagated signal may take any of a variety of forms, including, but not limited to, electro-magnetic, optical, or any suitable combination thereof.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method for delivering a game to a client device, the method comprising:

maintaining a plurality of user interface modules for the game on one or more machine-readable storage media, the user interface modules associated with a plurality of sites;

maintaining a plurality of partner adapters on the one or more machine-readable storage media, the partner adapters associated with the plurality of sites, the partner adapters configured to provide interfaces between the game when executed on the client device and the plurality of sites;

receiving into a memory, via a network interface device, a request to retrieve the game, the request including a site identifier for a site;

selecting, by a processor, based, at least in part on the site identifier, a user interface module from the plurality of user interface modules associated with the game;

selecting, by the processor, based, at least in part on the site identifier, a partner adapter from the plurality of partner adapters associated with the game;

assembling the user interface module and the partner adapter into the game; and providing, via the network interface device, the game to a source of the request.

2. The method of claim 1, wherein the site identifier identifies a web site providing a selection interface for selecting the game.

3. The method of claim 1, wherein the user interface module is configured for a set of one or more user interface elements that are specific to the site.

4. The method of claim 1, wherein receiving the request includes receiving an HTTP (Hyper Text Transfer Protocol) request including the site identifier.

5. The method of claim 1, wherein the site identifier comprises one of a URL (Uniform Resource Locator), a text string, or a code identifying the site.

6. The method of claim 1, wherein the game is provided to the client device and wherein the partner adapter provides an interface between the site identified by the site identifier and the game.

7. A non-transitory machine-readable storage medium having stored thereon instructions for causing one or more processors to perform operations for delivering a game-asset bundle to a client device, the operations including:

maintaining a plurality of user interface modules for a game on one or more machine-readable storage media, the user interface modules associated with a plurality of sites;

maintaining a plurality of partner adapters on the one or more machine-readable storage media, the partner adapters associated with the plurality of sites, the partner adapters configured to provide interfaces between the game when executed on the client device and the plurality of sites;

receiving into a memory, via a network interface device, a request to retrieve the game, the request including a site identifier for a site;

selecting, by a processor, based, at least in part on the site identifier, a user interface module from the plurality of user interface modules associated with the game;

selecting, by the processor, based, at least in part on the site identifier, a partner adapter from the plurality of partner adapters associated with the game;

assembling the user interface module and the partner adapter into the game; and providing, via the network interface device, the game to a source of the request.

8. The non-transitory machine-readable storage medium of claim 7, wherein the site identifier identifies a web site providing a selection interface for selecting the game.

9. The non-transitory machine-readable storage medium of claim 7, wherein the user interface module is configured for a set of one or more user interface elements that are specific to the site.

10. The non-transitory machine-readable storage medium of claim 7, wherein the site identifier comprises one of a URL (Uniform Resource Locator), a text string, or a code identifying the site.

11. The machine-readable storage medium of claim 7, wherein the game is provided to the client device and wherein the partner adapter provides an interface between the site identified by the site identifier and the game.

12. A wagering-game delivery system comprising:

one or more processors;

a network interface device coupled to at least one of the one or more processors;

one or more machine-readable storage media storing a plurality of user interface modules for a game and a plurality of partner adapters on, the user interface modules associated with a plurality of sites, the partner adapters associated with the plurality of sites, the partner adapters configured to provide interfaces between the game when executed on a client device and the plurality of sites; and one or more memory devices coupled to at least one of the one or more processors, the one or more memory devices storing instructions that, when executed, cause a resource server to:

receive into the one or more memory devices, via the network interface device, a request to retrieve the game, the request including a site identifier for a site;

select, by at least one of the one or more processors, based, at least in part on the site identifier, a user interface module from the plurality of user interface modules associated with the game;

select, by at least one of the one or more processors, based, at least in part on the site identifier, a partner adapter from the plurality of partner adapters associated with the game;

assemble the user interface module and the partner adapter into the game; and provide, via the network interface device, the game to a source of the request.

13. The wagering-game delivery system of claim 12, wherein the site identifier identifies a web site providing a selection interface for selecting the game.

14. The wagering-game delivery system of claim 12, wherein the user interface module is configured for a set of one or more user interface elements that are specific to the site.

15. The wagering-game delivery system of claim 12, wherein the request comprises an HTTP (Hyper Text Transfer Protocol) request including the site identifier.

16. The wagering-game delivery system of claim 12, wherein the site identifier comprises one of a URL (Uniform Resource Locator), a text string, or a code identifying the site.

17. The wagering-game delivery system of claim 12, wherein the game is provided to the client device and wherein the partner adapter provides an interface between the site identified by the site identifier and the game.

* * * * *